US008870355B2

(12) United States Patent
Tamaki

(10) Patent No.: US 8,870,355 B2
(45) Date of Patent: Oct. 28, 2014

(54) LIQUID EJECTING APPARATUS

(71) Applicant: Brother Kogyo Kabushiki Kaisha, Nagoya (JP)

(72) Inventor: Shuichi Tamaki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/040,182

(22) Filed: Sep. 27, 2013

(65) Prior Publication Data

US 2014/0092179 A1 Apr. 3, 2014

(30) Foreign Application Priority Data

Sep. 28, 2012 (JP) ..... 2012-218361

(51) Int. Cl.
*B41J 2/175* (2006.01)
*B41J 29/02* (2006.01)

(52) U.S. Cl.
CPC ..... *B41J 2/17513* (2013.01); *B41J 29/02* (2013.01); *F41J 2/17509* (2013.01); *F41J 2002/1728* (2013.01)
USPC ..... 347/85; 347/2

(58) Field of Classification Search
CPC ..... B41J 2/175; B41J 2/1752; B41J 2/17509; B41J 2/17513; B41J 2/17523; B41J 1/17553; B41J 29/02
USPC ..... 347/2, 7, 84–87, 108, 138, 152
See application file for complete search history.

(56) References Cited

U.S. PATENT DOCUMENTS

| | | | | |
|---|---|---|---|---|
| 4,893,137 | A * | 1/1990 | Ebinuma et al. | 346/134 |
| 5,909,226 | A * | 6/1999 | Takeda | 347/3 |
| 6,755,514 | B2 * | 6/2004 | Koga | 347/85 |
| 7,959,268 | B2 * | 6/2011 | Osawa et al. | 347/84 |
| 2006/0192823 | A1 | 8/2006 | Takagi | |
| 2008/0316282 | A1 | 12/2008 | Osawa et al. | |
| 2008/0316284 | A1 | 12/2008 | Osawa et al. | |

FOREIGN PATENT DOCUMENTS

| | | | |
|---|---|---|---|
| JP | 2006-239880 | A | 9/2006 |
| JP | 2010-083103 | A | 4/2010 |
| JP | 2010-188734 | A | 9/2010 |

* cited by examiner

*Primary Examiner* — Anh T. N. Vo
(74) *Attorney, Agent, or Firm* — Merchant & Gould PC

(57) ABSTRACT

A first part of liquid holders includes at least one liquid holder provided at the first casing. A second part of liquid holders includes at least one liquid holder provided at the second casing. Each of a plurality of flexible tubes has one end and another end. The one end is connected to the first part of the liquid holders. The other end is connected to the second part of the liquid holders. A first supporting section is provided at the first casing and supports the tubes. A second supporting section is provided at the second casing and supports the tubes. A third supporting section supports the tubes at a position between the first supporting section and the second supporting section in such a manner that the tubes are arranged in a direction parallel to a pivotal axis.

16 Claims, 10 Drawing Sheets

LIQUID EJECTING APPARATUS

CROSS REFERENCE TO RELATED APPLICATIONS

This application claims priority from Japanese Patent Application No. 2012-218361 filed Sep. 28, 2012. The entire content of the priority application is incorporated herein by reference.

TECHNICAL FIELD

The invention relates to a liquid ejecting apparatus that ejects liquid from ejection ports.

BACKGROUND

A printer is known in which an upper casing (e.g. second casing) is pivotally supported by a main casing (e.g. first casing) so as to be pivotally movable relative to the main casing (e.g. first casing) about a pivotal axis. This printer includes a plurality of tubes provided to transfer liquid between the upper casing and the main casing. Each tube is supported by supporting sections provided at the main casing and the upper casing, respectively.

SUMMARY

The plurality of tubes is not supported between the supporting section of the main casing and the supporting section of the upper casing. With this configuration, when the upper casing is pivotally moved, the plurality of tubes sometimes twists together between the supporting section of the main casing and the supporting section of the upper casing, and a part of the tubes is sometimes bent sharply or stretched excessively.

In view of the foregoing, it is an object of this specification to disclose a liquid ejecting apparatus that can prevent a part of the tubes from being bent sharply or stretched excessively when a second casing is pivotally moved.

In order to attain the above and other objects, this specification discloses a liquid ejecting apparatus. The liquid ejecting apparatus includes a first casing, a second casing, a plurality of liquid holders, a plurality of flexible tubes, a first supporting section, a second supporting section, and a third supporting section. The second casing is configured to pivotally move about a pivotal axis relative to the first casing. The second casing is configured to take an adjacent position at which the second casing is adjacent to the first casing and a spaced position at which the second casing is farther spaced away from the first casing than at the adjacent position. A first part of the plurality of liquid holders includes at least one liquid holder provided at the first casing. A second part of the plurality of liquid holders includes at least one liquid holder provided at the second casing. The second part of the plurality of liquid holders is different from the first part of the plurality of liquid holders. Each of the plurality of flexible tubes has one end and another end. The one end is connected to the first part of the plurality of liquid holders. The other end is connected to the second part of the plurality of liquid holders. The first supporting section is provided at the first casing and is configured to support the plurality of tubes. The second supporting section is provided at the second casing and is configured to support the plurality of tubes. The third supporting section is configured to support the plurality of tubes at a position between the first supporting section and the second supporting section in such a manner that the plurality of tubes is arranged in a direction parallel to the pivotal axis.

BRIEF DESCRIPTION OF THE DRAWINGS

Embodiments in accordance with the invention will be described in detail with reference to the following figures wherein.

DETAILED DESCRIPTION

A liquid ejecting apparatus according to some aspects of the invention will be described while referring to the accompanying drawings. In the following description, the expressions "front", "rear", "upper", "lower", "right", and "left" are used to define the various parts when the liquid ejecting apparatus is disposed in an orientation in which it is intended to be used.

First Embodiment

First, the overall configuration of an inkjet-type printer 1 according to a first embodiment will be described while referring to FIGS. 1A through 2B.

Figure 1A:
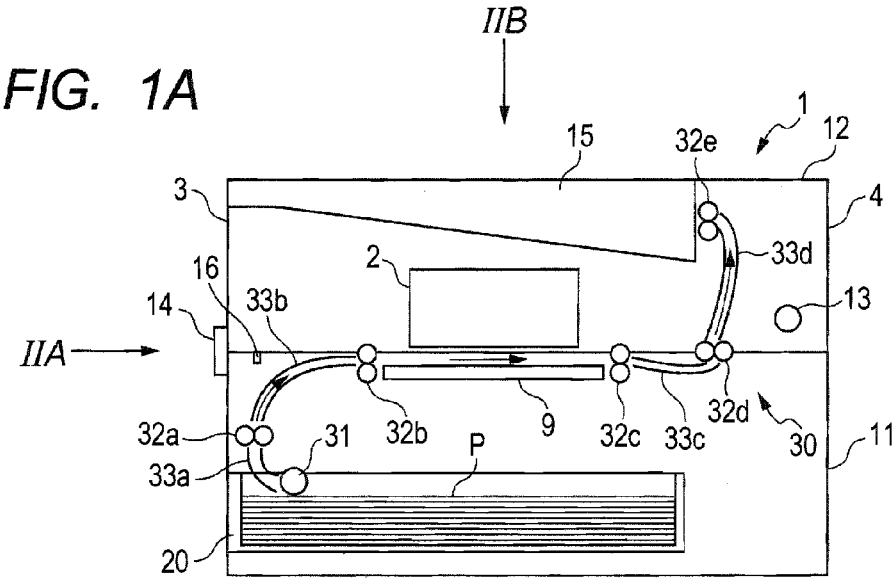
FIG. 1A is a schematic side view showing the internal structure of an inkjet-type printer according to a first embodiment of the invention, in a state where an upper casing is located at a closed position.
Figure 1B:
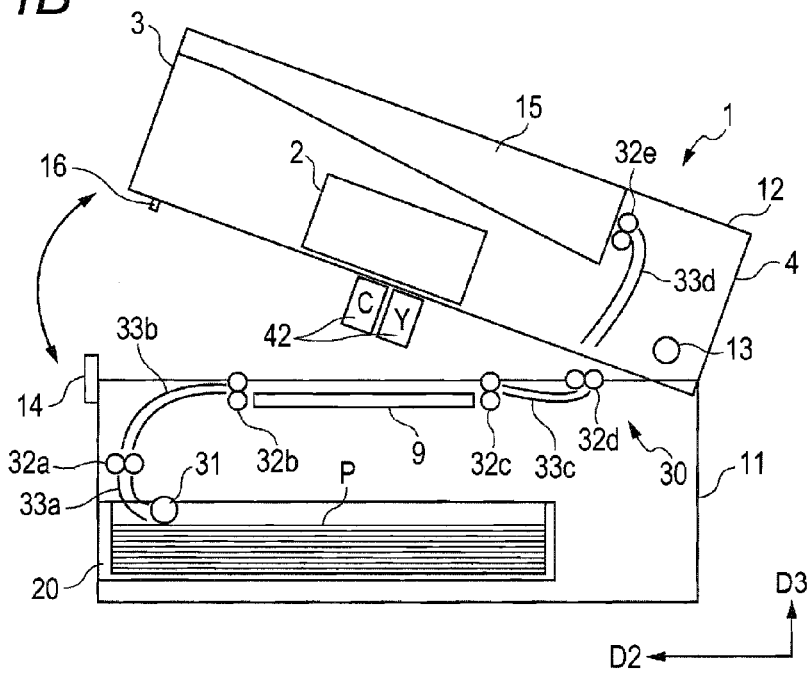
FIG. 1B is a schematic side view showing the internal structure of the printer, in a state where an upper casing is located at an open position.

The printer 1 includes a lower casing (first casing) 11 and an upper casing (second casing) 12, both of which have a rectangular-parallelepiped shape. The left-side surface in FIGS. 1A and 1B is a front surface 3. The right-side surface in FIGS. 1A and 1B is a rear surface 4. The lower side of the upper casing 12 is opened, and the upper side of the lower casing 11 is opened. The upper casing 12 is coupled to the lower casing 11 by a pivotal shaft 13 (a shaft extending in the direction of the pivotal axis) such that the upper casing 12 can pivotally move about the pivotal shaft 13. The upper casing 12 pivotally moves between: a closed position (adjacent position: FIG. 1A) at which the open sides of the upper casing 12 and lower casing 11 are closed so that an internal space of the printer 1 is defined; and an open position (spaced position: FIG. 1B) at which the internal space of the printer 1 is opened. An open/close sensor 16 is fixed to the lower surface of the upper casing 12. The open/close sensor 16 is configured to output a detection signal when the upper casing 12 is at the closed position, and not to output the detection signal when the upper casing 12 is at the open position. The printer 1 includes a lock mechanism 14 that restricts pivotal movement of the upper casing 12 when the upper casing 12 is at the closed position. The lock mechanism 14 can lock/unlock under controls of a controller 1*p* (see FIG. 6). A paper discharge section 15 is provided at the upper surface of the upper casing 12. Sheets of paper P on which printing is finished are discharged sequentially onto the paper discharge section 15.

In the internal space of the printer 1, four ink-cartridge mount sections 41*a*, four subsidiary tanks 42 each having smaller volume than volume of each ink cartridge 41, an inkjet head 2, a paper tray 20, a paper conveying mechanism 30, a platen 9, and a waste liquid tank 47 are arranged.

Figure 2A:
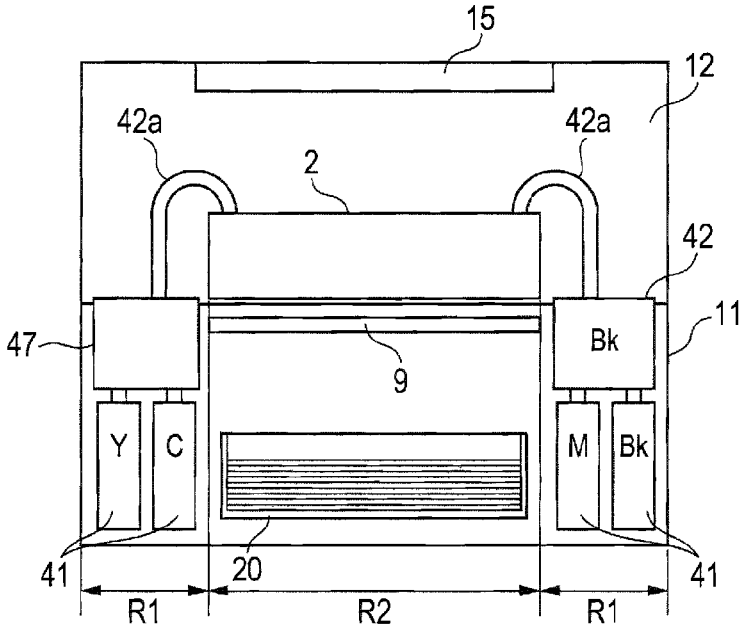
FIG. 2A is a schematic front view showing the internal structure of the printer, as viewed from the direction shown by an arrow IIA in FIG. 1A.
Figure 2B:
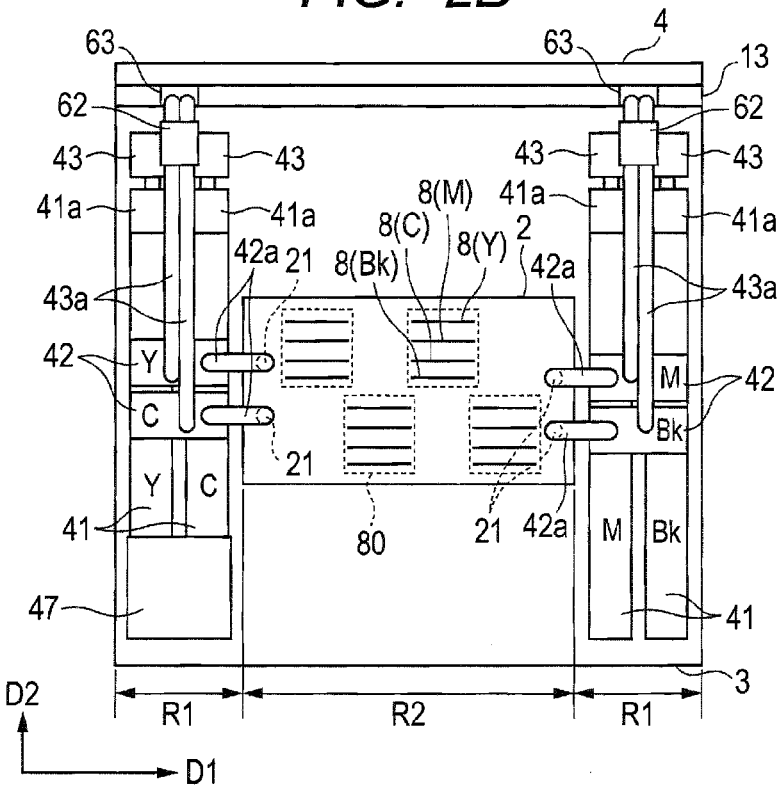
FIG. 2B is a schematic plan view showing the internal structure of the printer, as viewed from the direction shown by an arrow IIB in FIG. 1A.
Figure 3A:
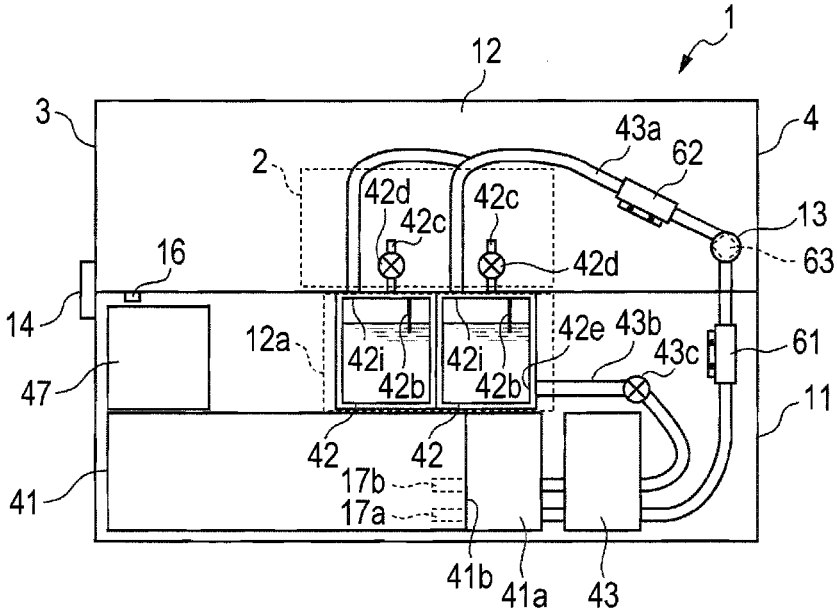
FIG. 3A is a schematic side view showing the internal structure of the printer in a state where the upper casing is located at the closed position.
Figure 3B:
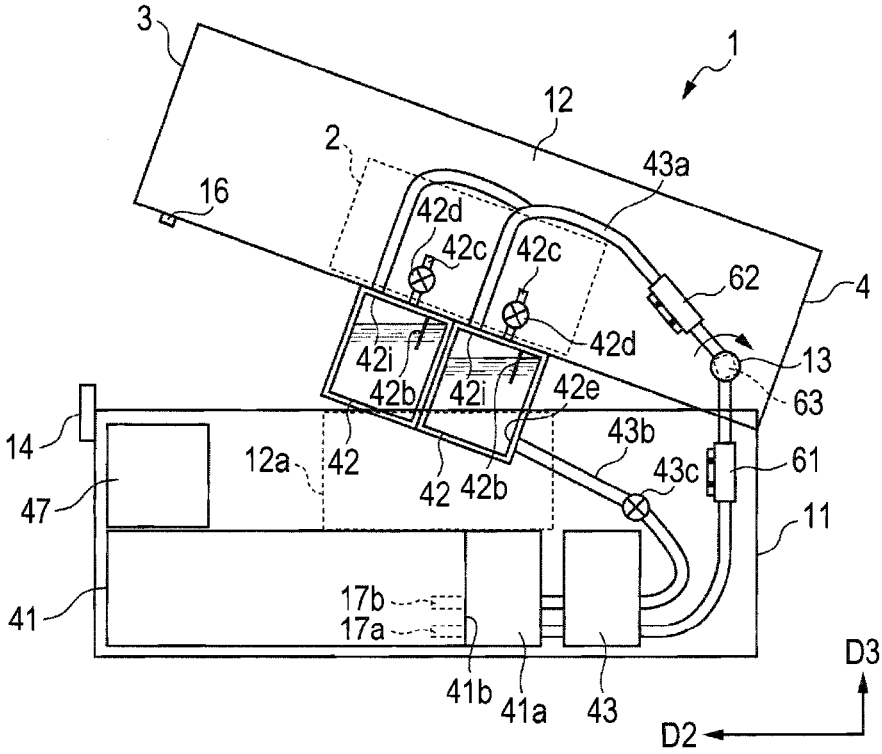
FIG. 3B is a schematic side view showing the internal structure of the printer in a state where the upper casing is located at the open position.

Four ink cartridges 41 storing ink in different kinds (Y: yellow, C: cyan, M: magenta, Bk: black) are mounted on respective ones of the four ink-cartridge mount sections 41*a*. Each of the ink-cartridge mount sections 41*a* is fixed to the lower casing 11. Four ink-cartridge mount sections 41*a* are arranged at the same height. As shown in FIGS. 3A and 3B, each of the ink-cartridge mount sections 41*a* has two needles 17*a* and 17*b* that are inserted into the ink cartridge 41 when the ink cartridge 41 is mounted. The needles 17*a* and 17*b* are arranged at positions of each ink-cartridge mount section 41*a* that confronts a surface 41*b* of the ink cartridge 41 at the rear surface 4 side, in a state where the ink cartridge 41 is mounted on the ink-cartridge mount section 41*a*. Each of the needles 17*a* and 17*b* extends in a sub-scanning direction D2. Each ink-cartridge mount section 41*a* is disposed at the rear surface 4 side of the ink cartridge 41 mounted on the corresponding ink-cartridge mount section 41*a*. Further, the ink-cartridge mount section 41*a* is disposed at the rear surface 4 side of the subsidiary tanks 42 with respect to the sub-scanning direction D2. Further, two of the four ink-cartridge mount sections 41*a* are arranged at each outer side of the inkjet head 2 with respect to a main scanning direction D1. In other words, two of the four ink-cartridge mount sections 41*a* are arranged in each first range R1 (see FIGS. 2A and 2B) which is a range not overlapping the inkjet head 2 with respect to the main scanning direction D1. Here, a range overlapping the inkjet head 2 with respect to the main scanning direction D1 is referred to as a second range R2. In other words, the first range R1 is defined as a range, with respect to the main scanning direction D1, other than a range in which the inkjet head 2 extends. The second range R2 is defined as a range, with respect to the main scanning direction D1, in which the inkjet head 2 extends.

The ink cartridge 41 has substantially a rectangular-parallelepiped shape. Because each ink cartridge 41 is mounted on the ink-cartridge mount section 41*a* fixed to the lower casing 11, the ink cartridge 41 mounted on the ink-cartridge mount section 41*a* is held by the lower casing 11. When the four ink cartridges 41 are mounted on the respective four ink-cartridge mount sections 41*a*, the longitudinal direction of each ink cartridge 41 is in the sub-scanning direction D2 that is perpendicular to a direction in which the pivotal shaft 13 extends (hereinafter, referred to as the main scanning direction D1). When mounted on the ink-cartridge mount sections 41*a*, two of the four ink cartridges 41 are arranged at each outer side of the inkjet head 2 with respect to the main scanning direction D1. In other words, when mounted on the ink-cartridge mount sections 41*a*, two of the four ink cartridges 41 are arranged in each first range R1. Specifically, the yellow and cyan ink cartridges 41 are arranged at a bottom portion of the lower casing 11 at the left side (FIGS. 2A and 2B) in the main scanning direction D1, whereas the magenta and black ink cartridges 41 are arranged at the right side in FIGS. 2A and 2B. The ink cartridge 41 can be mounted on the ink-cartridge mount section 41*a* by inserting the ink cartridge 41 in the sub-scanning direction D2 from the front surface of the lower casing 11, i.e., from the front surface 3 side toward the rear surface 4 side. That is, the insertion direction of the ink cartridge 41 is the sub-scanning direction D2.

Each of the four subsidiary tanks 42 has substantially a rectangular-parallelepiped shape. As shown in FIGS. 3A and 3B, an ink inlet port 42*i* through which ink supplied from the ink cartridge 41 flows in is formed on an upper surface of each subsidiary tank 42. A liquid level sensor 42*b* that detects a liquid level of ink stored therein is disposed within the subsidiary tank 42. The ink inlet port 42*i* is formed at a position on the upper surface of the subsidiary tank 42, the position being farthest away from the pivotal shaft 13. When the upper casing 12 is located at the open position, the ink inlet port 42*i* is located at a higher position than a highest liquid level of ink stored in the subsidiary tank 42 with respect to the vertical direction D3 (FIG. 3B). The highest liquid level of ink stored in the subsidiary tank 42 is a liquid level of ink in a state where ink stored in the subsidiary tank 42 is the maximum amount.

The ink inlet ports 42*i* of the four subsidiary tanks 42 and the corresponding ink-cartridge mount sections 41*a* are connected with each other via tubes 43*a*. Further, the tubes 43*a* and the corresponding ink cartridges 41 are connected with each other via the needles 17*a*.

An atmosphere communication opening 42*c* is formed at the upper surface of each subsidiary tank 42. A valve 42*d* is provided at the atmosphere communication opening 42*c*. When the valve 42*d* is opened, a space within the subsidiary tank 42 is communicated with the atmosphere via the atmosphere communication opening 42*c*. When the valve 42*d* is closed, the space within the subsidiary tank 42 is blocked from the atmosphere. An ink outlet port 42*e* is formed on a side surface of each subsidiary tank 42. The ink outlet port 42*e* is formed at a lower end portion of the side surface of the subsidiary tank 42. The ink outlet port 42*e* and the corresponding ink-cartridge mount section 41*a* are connected with each other via a tube 43*b*. Further, the tube 43*b* and the corresponding ink cartridge 41 are connected with each other via the needle 17*b*. In FIGS. 3A and 3B, although the above configuration is shown only for one subsidiary tank 42, the other subsidiary tanks 42 have similar configurations.

As shown in FIGS. 1A through 2B, two of the four subsidiary tanks 42 are arranged at each outer side of the inkjet head 2 with respect to the main scanning direction D1. In other words, two of the four subsidiary tanks 42 are arranged in each first range R1. Each subsidiary tank 42 is arranged at a position overlapping the ink cartridge 41 mounted on the corresponding ink-cartridge mount section 41*a* in the vertical direction D3. Specifically, the yellow and cyan subsidiary tanks 42 are arranged, in this order from the rear surface 4 side, at the upper casing 12 at the left side (FIG. 2B) in the main scanning direction D1, whereas the magenta and black subsidiary tanks 42 are arranged, in this order from the rear surface 4 side, at the right side. When the upper casing 12 is located at the closed position, the four subsidiary tanks 42 are arranged at the same height. That is, when the upper casing 12 is located at the closed position, the positions of lower end portions of the four subsidiary tanks 42 with respect to the vertical direction D3 are the same. Note that the magenta and black subsidiary tanks 42 are omitted in FIGS. 1A and 1B for simplicity.

Each subsidiary tank 42 is arranged in such a manner that a liquid level of each subsidiary tank 42 is located at a lower position than the ejection surface of the inkjet head 2, so as to keep the liquid level of each subsidiary tank 42 and the ejection surface of the inkjet head 2 within a predetermined range of head differential. Hence, the subsidiary tank 42 protrudes from the lower surface of the upper casing 12. When the upper casing 12 is located at the closed position, the lower end portion of the subsidiary tank 42 is located at a lower position than the lower end portion of the upper casing 12 with respect to the vertical direction D3, and is located at a lower position than the platen 9 (described later) and the pivotal shaft 13 with respect to the vertical direction D3. Note that the lower casing 11 is formed with a space region in which protruding sections of the subsidiary tanks 42 are inserted when the upper casing 12 is located at the closed position. For example, this space region is formed by providing a concave region 12*a* at the lower casing 11.

The pump 43 is provided at a middle portion of the tube 43*a*. The pump 43 is fixed to the lower casing 11. The pump 43 is disposed at the rear surface 4 side of the corresponding ink-cartridge mount section 41*a* (the downstream side in an insertion direction of the ink cartridge 41). The pump 43 is disposed at a position overlapping the ink cartridge 41 and the ink-cartridge mount section 41*a* in the sub-scanning direction D2. By driving the pump 43 as necessary, ink is supplied to the subsidiary tank 42 via the tube 43*a* from the ink cartridge 41 mounted on the corresponding ink-cartridge mount section 41*a*.

Figure 4A:
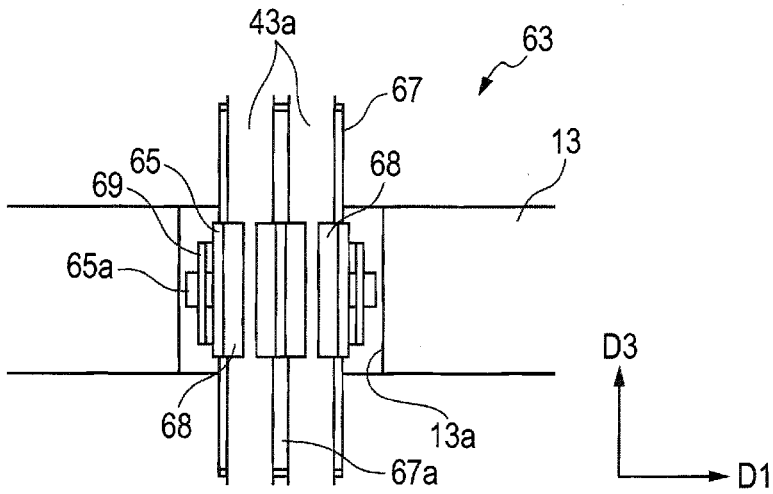
FIG. 4A is a rear view showing a third supporting section of the printer shown in FIGS. 1A and 1B.
Figure 4B:
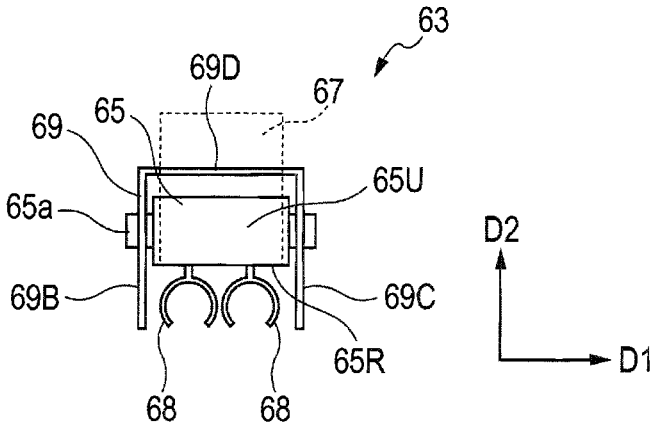
FIG. 4B is a top view of the third supporting section in FIG. 4A.
Figure 5A:
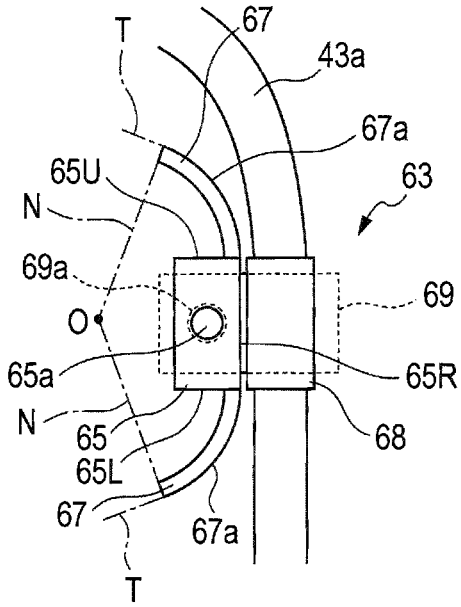
FIG. 5A is a side view of the third supporting section in a state where the upper casing shown in FIGS. 1A and 1B is located at the open position.
Figure 5B:
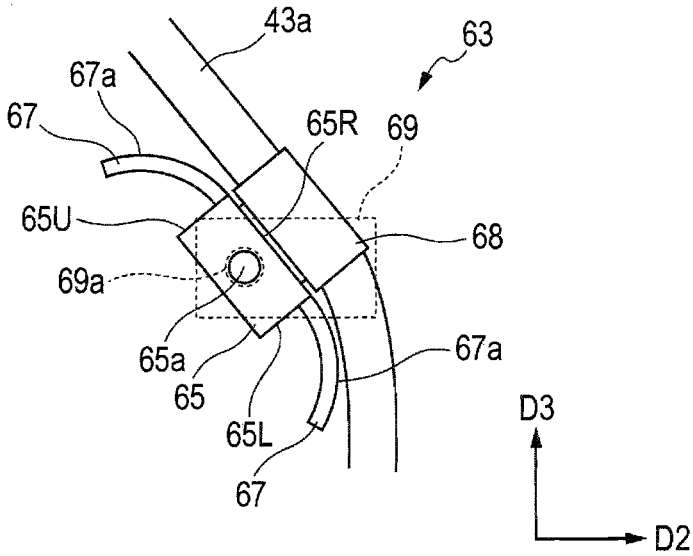
FIG. 5B is a side view of the third supporting section in a state where the upper casing shown in FIGS. 1A and 1B is located at the closed position.

In this way, the tube 43*a* transfers ink between the upper casing 12 and the lower casing 11. In each first range R1, two tubes 43*a* connecting the two ink-cartridge mount sections 41*a* and the two subsidiary tanks 42 are juxtaposed (arranged side by side) in a horizontal direction (an extending direction of the pivotal shaft 13). The two tubes 43*a* are supported by one first supporting section 61 fixed to the lower casing 11, and are also supported by one second supporting section 62 fixed to the upper casing 12, in a state where the two tubes 43*a* are juxtaposed in the horizontal direction. The first supporting section 61 is disposed at a lower side of the pivotal shaft 13, whereas the second supporting section 62 is disposed at an upper side of the pivotal shaft 13. Further, the two tubes 43*a* are supported by one third supporting section 63 at a position between the first supporting section 61 and the second supporting section 62, in a state where the two tubes 43*a* are juxtaposed in the horizontal direction. The third supporting section 63 is rotatably supported so as to be coaxial with the pivotal shaft 13. The third supporting section 63 is movable relative to the upper casing 12 and the lower casing 11 (FIGS. 4A and 4B). More specifically, the third supporting section 63 is rotatable, without shifting its position, relative to the upper casing 12 and the lower casing 11. Here, an idea that the third supporting section 63 moves relative to the upper casing 12 and the lower casing 11 includes an idea that the third supporting section 63 rotatably moves, without shifting its position, relative to the upper casing 12 and the lower casing 11, as illustrated in the present embodiment. The third supporting section 63 will be described later in greater detail.

A valve 43*c* is provided at a middle portion of the tube 43*b*. When the valve 43*c* is opened, a space within the subsidiary tank 42 is communicated with the corresponding ink cartridge 41. When the valve 43*c* is closed, the space within the subsidiary tank 42 is blocked from the corresponding ink cartridge 41. When the valve 42*d* and the valve 43*c* are opened, ink in the subsidiary tank 42 is returned to the corresponding ink cartridge 41 due to the head differential between the subsidiary tank 42 and the corresponding ink cartridge 41. The tube 43*b* is not supported by the first through third supporting sections 61-63 in the present embodiment. However, the tube 43*b* may be supported by the first through third supporting sections 61-63.

The inkjet head 2 has substantially a rectangular-parallelepiped shape. The inkjet head 2 is disposed at substantially a center portion of the upper casing 12 with respect to the sub-scanning direction D2. The inkjet head 2 has, at its lower surface, an ejection surface in which a plurality of ejection ports 8 for ejecting ink droplets is formed. The ejection surface of the inkjet head 2 is located at approximately the same position as the lower end of the upper casing 12 with respect to the vertical direction D3. The ejection surface of the inkjet head 2 has a plurality of ejection-port arrays. In each ejection-port array, the plurality of ejection ports 8 is arranged at equal intervals along the main scanning direction D1. Four ink supply ports 21 are formed at the upper surface of the inkjet head 2. Two of the four subsidiary tanks 42 are arranged at each outer side of the inkjet head 2 with respect to the main scanning direction D1. The ink supply ports 21 arranged at one side of the ejection surface with respect to the main scanning direction D1 are connected with the subsidiary tanks 42 arranged at the one side of the inkjet head 2 with respect to the main scanning direction D1 via the tubes 42*a*. The ink supply ports 21 arranged at the other side of the ejection surface with respect to the main scanning direction D1 are connected with the subsidiary tanks 42 arranged at the other side of the inkjet head 2 with respect to the main scanning direction D1 via the tubes 42*a*.

Four ink channels (not shown) are formed inside the inkjet head 2. The four ink channels are communicated with the different ink supply ports 21, and extend in a direction in which the pivotal shaft 13 extends (the main scanning direction D1). Each ink channel is communicated with the plurality of ejection ports 8 via pressure chambers (not shown). Actuators (not shown) apply pressure to the pressure chambers, which causes ink droplets to be ejected from the ejection ports 8.

A plurality of ejection blocks 80 in staggered arrangement with respect to the main scanning direction D1 is defined in the ejection surface of the inkjet head 2. Each ejection block 80 includes ejection-port arrays (ejection-port groups) for the respective ones of the ink cartridges 41, in other words, for kinds of ink (Y, C, M, Bk). In each of the ejection-port arrays, the ejection ports 8 are arranged at equal intervals in the main scanning direction D1. That is, the number of the ejection-port arrays and the number of the subsidiary tanks 42 are the same, which is four. The four ejection-port arrays are arranged in the sequence of Y, M, C, Bk from the rear surface 4 side, with respect to the kinds of ink.

The paper tray 20 is configured to hold a plurality of sheets of paper P that are stacked. The paper tray 20 is detachably disposed at the bottom of the lower casing 11 in such a manner that the paper tray 20 is interposed between the ink cartridges 41 from the both sides in the main scanning direction D1. The paper tray 20 can be mounted or dismounted through the front surface of the lower casing 11 in the sub-scanning direction D2. The paper tray 20 is disposed at a position overlapping the inkjet head 2 in the vertical direction D3. In other words, the paper tray 20 is disposed in the second range R2.

The platen 9 is a plate member for supporting paper P. The platen 9 is fixed to the lower casing 11 in such a manner that the platen 9 confronts the ejection surface of the inkjet head 2 when the upper casing 12 is at the closed position. When the upper casing 12 is at the open position, the ejection surface of the inkjet head 2 is farther spaced away from the platen 9 than at the closed position. The size of the platen 9 in the main scanning direction D1 and in the sub-scanning direction D2 is slightly larger than the size of the ejection surface. The platen 9 is disposed at a position overlapping the inkjet head 2 in the vertical direction D3. In other words, the platen 9 is disposed in the second range R2.

The paper conveying mechanism 30 constitutes a conveying path of paper P starting from the paper tray 20, passing between the inkjet head 2 and the platen 9, and reaching the paper discharge section 15. The paper conveying mechanism 30 includes a pickup roller 31, nip rollers 32*a*-32*e*, and guides 33*a*-33*d*. The pickup roller 31 sends sheets of paper P stacked on the paper tray 20 one sheet at a time from the top. The nip rollers 32*a*-32*e* are arranged along the conveying path and apply conveying force to paper P. The guides 33*a*-33*d* are arranged on the conveying path between the pickup roller 31 and the nip rollers 32*a*-32*e*, respectively. The guides 33*a*-33*d* guide paper P until paper P applied with conveying force by one of the nip rollers 32*a*-32*e* reaches the next (downstream) one of the nip rollers 32*a*-32*e*. When paper P being conveyed by the paper conveying mechanism 30 passes between the inkjet head 2 and the platen 9, an image is printed on the paper P with ink droplets that are ejected from the ejection ports 8 of the inkjet head 2. The paper P on which the image is printed is further conveyed by the paper conveying mechanism 30, and is discharged onto the paper discharge section 15. The pickup roller 31, the nip rollers 32*a*-32*d*, and the guides 33*a*-33*c* are fixed to the lower casing 11. The nip roller 32*e* and the guide 33*d* are fixed to the upper casing 12.

The waste liquid tank 47 has substantially a rectangular-parallelepiped shape. The waste liquid tank 47 stores waste ink that is discharged from the ejection ports 8 of the inkjet head 2. Waste ink is generated due to a maintenance operation for preventing clogging or the like of the ejection ports 8 of the inkjet head 2 (for example, a purge operation of discharging a large amount of ink from the ejection ports 8, etc.). The waste liquid tank 47 is disposed in the first range R1. The waste liquid tank 47 is disposed above the ink cartridge 41 (Y) and the ink cartridge 41 (C), and overlaps the ink cartridges 41 in the vertical direction D3. The waste liquid tank 47 is disposed at a position overlapping the subsidiary tanks 42 when the upper casing 12 is at the closed position (that is, the concave region 12*a*) in the sub-scanning direction D2, and is disposed at the front surface 3 side of the subsidiary tanks 42 when the upper casing 12 is at the closed position. With this arrangement, the waste liquid tank 47 can be replaced easily. Further, because the waste liquid tank 47 is disposed at a position overlapping the concave region 12*a* in the sub-scanning direction D2, a space near the concave region 12*a* can be utilized efficiently.

As described above, as the overall configuration, when the upper casing 12 is located at the closed position, the subsidiary tanks 42 and the ink cartridges 41 are arranged, in this sequence from the top, to overlap each other in a plan view, within the first range R1 not overlapping the inkjet head 2 with respect to the main scanning direction D1. The inkjet head 2, the platen 9, and the paper tray 20 are arranged, in this sequence from the top, to overlap each other in a plan view, within the second range R2 overlapping the inkjet head 2 with respect to the main scanning direction D1. With this configuration, each member can be accommodated efficiently.

As shown in FIGS. 3A and 3B, when the inside of the printer 1 need to be opened for the maintenance operation, such as when paper P is jammed on the conveying path, the user pivotally moves the upper casing 12 from the closed position to the open position. With this operation, the space between the inkjet head 2 and the platen 9 is opened, so that the maintenance operation can be performed easily.

The third supporting section 63 will be described in greater detail with reference to FIGS. 4A through FIG. 5B. As shown in FIGS. 4A through FIG. 5B, the third supporting section 63 supports the two tubes 43*a* in a state where the two tubes 43*a* are juxtaposed (arranged side by side) in the extending direction of the pivotal shaft 13. The third supporting section 63 includes a block 65, two gripping sections 68, and guides 67. The block 65 has a rectangular-parallelepiped shape. The block 65 has an upper surface 65U facing upward, a lower surface 65L facing downward, a rear surface 65R facing rearward, and the like. A pair of cylindrical shafts 65*a* protrudes from the both ends of the block 65 in the main scanning direction D1. The pair of the shafts 65*a* is an example of protruding sections (support shaft). Each of the two gripping sections 68 is curved in a C-shape, in cross section (FIG. 4B), so as to grip the outer circumferential surface of the tube 43*a*. The two gripping sections 68 are fixed to the rear surface 65R (the surface confronting the tubes 43*a*) of the block 65 in such a manner that the two gripping sections 68 are juxtaposed so that the gripped tubes 43*a* are parallel to each other. The guides 67 are fixed to respective ones of the upper surface 65U and the lower surface 65L (the two surfaces adjacent to the rear surface 65R in the extending direction of the tube 43*a* (a direction perpendicular to the axis of the shafts 65*a*)). In other words, the guides 67 extend from the upper surface 65U and the lower surface 65L of the block 65. Each guide 67 has a guiding surface 67*a* that is curved so as to support the inner side of curved portions of the two tubes 43*a* gripped by the two gripping sections 68. The guiding surface 67*a* is curved with a curvature radius that is larger than or equal to a smallest curvature radius of the tubes 43*a*. The smallest curvature radius of the tubes 43*a* is a limit curvature radius that the tube 43*a* does not bend sharply when the flexible tube 43*a* is curved. The smallest curvature radius depends upon the material of a tube. Further, a center angle of an arc defined by the guiding surface 67*a* (a center angle with respect to a center point O) is larger than or equal to 90 degrees. More preferably, the center angle is larger than or equal to 180 degrees. For example, as shown in 5A, the center point O can be determined by drawing tangent lines T of upper and lower ends of the guiding surfaces 67*a*, and drawing normal lines N from the upper and lower ends of the guiding surfaces 67*a*, and determining the intersection of the normal lines N as the center point O. This configuration can reliably suppress a situation in which the tubes 43*a* supported by the guiding surface 67*a* bend sharply at a portion other than the guiding surface 67*a*.

As shown in FIG. 4A, a concave portion 13*a* is formed at the pivotal shaft 13. A frame 69 (a part of the restricting section) is fixed to the concave portion 13*a* of the pivotal shaft 13 at substantially a center position in each first range R1 (FIG. 2B). As shown in FIG. 4B, as viewed from the upper side, the frame 69 has a squared-U shape formed by plate members. The frame 69 includes plate members 69B and 69C confronting each other, and a plate member 69D connecting the plate members 69B and 69C. Holes 69*a* are formed in the plate members 69B and 69C. Each hole 69*a* has a circular shape. The plate member 69D is fixed to the pivotal shaft 13 (the concave portion 13*a*). The pair of holes 69*a* is arranged to be aligned with the axis of the pivotal shaft 13. The pair of shafts 65*a* of the block 65 is inserted in the pair of the holes 69*a* of the frame 69. With this configuration, the shafts 65*a* are disposed to be on the same straight line as the axis of the pivotal shaft 13. The third supporting section 63 is supported by the frame 69 so as to be rotatable about the shafts 65*a*, while the moving range of the third supporting section 63 is restricted. In the present embodiment, the frame 69 is fixed to the concave portion 13*a* of the pivotal shaft 13. However, the frame 69 may be fixed to one of the lower casing 11 and the upper casing 12.

Figure 6:
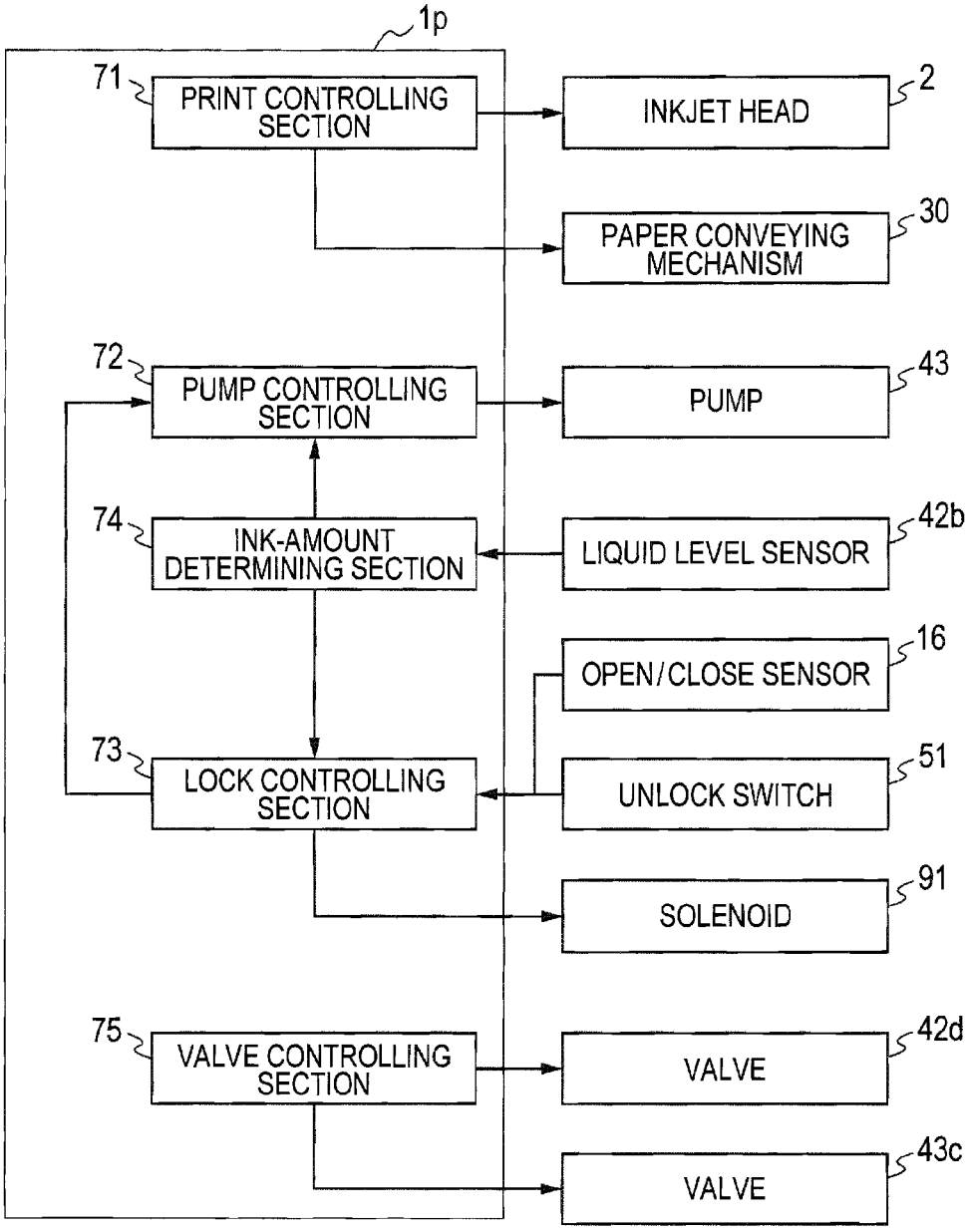
FIG. 6 is a control block diagram of the printer shown in FIGS. 1A and 1B.

Next, the controller 1*p* for controlling the printer 1 will be described. As shown in FIG. 6, the controller 1*p* includes a print controlling section 71, an ink-amount determining section 74, a pump controlling section 72, a lock controlling section 73, and a valve controlling section 75. The print controlling section 71 controls operations of the inkjet head 2 and the paper conveying mechanism 30, so that a desired image is printed on paper P. The ink-amount determining section 74 determines an amount of ink stored in the subsidiary tank 42, based on a detection result of the liquid level sensor 42*b* of the subsidiary tank 42. The pump controlling section 72 controls driving of the pump 43. Specifically, upon pressing of an unlock switch 51, the pump controlling section 72 drives the pump 43 so that ink is supplied from the ink cartridge 41 to the subsidiary tank 42, if the amount of ink determined by the ink-amount determining section 74 is less than a predetermined amount. The unlock switch 51 is provided at the lock mechanism 14 and is configured to be pressed by a user. When the amount of ink stored in the subsidiary tank 42 becomes the predetermined amount, the pump controlling section 72 stops driving of the pump 43. The lock controlling section 73 controls the lock mechanism 14 based on a state of the unlock switch 51 and on a determination result of the ink-amount determining section 74. The valve controlling section 75 controls opening/closing of the valves 42*d* and 43*c*.

Figure 7:
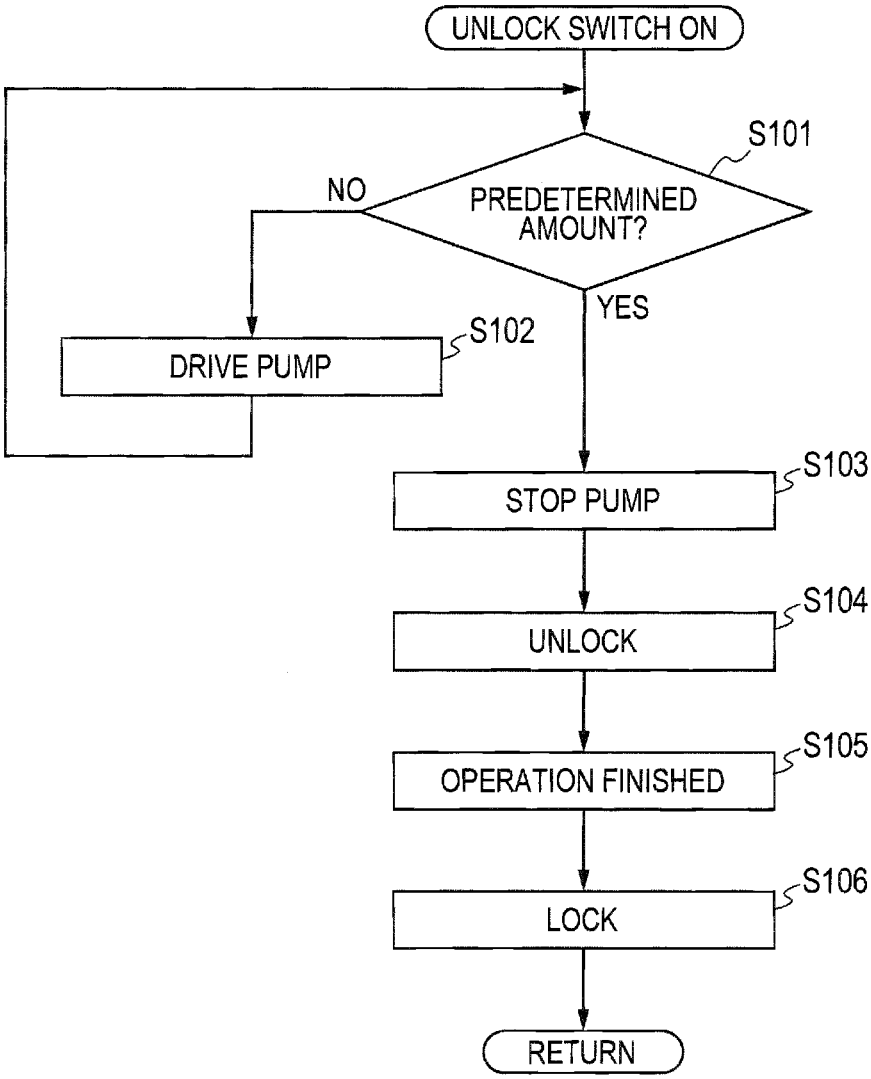
FIG. 7 is a flowchart showing processes performed during a maintenance operation of the printer shown in FIGS. 1A and 1B.

The operations of the printer 1 will be described in a case where a user voluntarily performs the maintenance operation, with reference to FIG. 7. Normally, the lock mechanism 14 is in a locked state (a rotation restricted state of the upper casing 12). Thus, when the user wishes to voluntarily perform the maintenance operation, the user presses the unlock switch 51 to indicate his/her intention to move the upper casing 12 to the open position. Upon pressing of the unlock switch 51, the ink-amount determining section 74 determines whether the subsidiary tank 42 stores a predetermined amount of ink (that is, whether the ink storage amount is the predetermined amount or less than the predetermined amount) (S101). If the ink-amount determining section 74 determines that the subsidiary tank 42 does not store the predetermined amount of ink (the ink storage amount is less than the predetermined amount) (S101: No), the pump controlling section 72 drives the pump 43 to supply the subsidiary tank 42 with ink (S102) until the ink-amount determining section 74 determines that the subsidiary tank 42 stores the predetermined amount of ink (S101: Yes).

If the ink-amount determining section 74 determines that the subsidiary tank 42 stores the predetermined amount of ink (S101: Yes), the pump controlling section 72 stops driving of the pump 43 (S103). The lock controlling section 73 puts the lock mechanism 14 in an unlocked state (a rotation allowed state of the upper casing 12) (S104). Subsequently, if the open/close sensor 16 detects that the upper casing 12 is returned to the closed position after the user performs the maintenance operation in a state where the upper casing 12 is at the open position (S105), the lock controlling section 73 puts the lock mechanism 14 in the locked state (S106). Then, the flowchart in FIG. 7 ends.

At the time of the above-described maintenance operation, with pivotal movement of the upper casing 12 between the closed position and the open position, the second supporting section 62 moves relative to the first supporting section 61. When the upper casing 12 pivotally moves from the closed position to the open position, the second supporting section 62 moves away from the first supporting section 61. That is, the distance between the first supporting section 61 and the second supporting section 62 increases. Thus, with movement of the second supporting section 62, the tubes 43*a* supported by the first supporting section 61 and the second supporting section 62 are deformed to be stretched. That is, when the upper casing 12 pivotally moves from the closed position to the open position, the tubes 43*a* are deformed such that deflection of the tubes 43*a* decreases. At this time, with deformation of the tubes 43*a*, the third supporting section 63 supporting the tubes 43*a* between the second supporting section 62 and the first supporting section 61 rotatably moves about the shafts 65*a*. The third supporting section 63 rotatably moves such that the two tubes 43*a* are curved smoothly between the first supporting section 61 and the third supporting section 63, and between the second supporting section 62 and the third supporting section 63, while maintaining a state in which the two tubes 43*a* are juxtaposed (arranged) in a horizontal direction, that is, a direction parallel to the axis of the pivotal shaft 13. Specifically, when the upper casing 12 pivotally moves from the closed position to the open position, the second supporting section 62 pivotally moves upward about the pivotal shaft 13 and, with this movement of the second supporting section 62, the third supporting section 63 rotatably moves clockwise in FIG. 5B about the axis of the pivotal shaft 13. Conversely, when the upper casing 12 pivotally moves from the open position to the closed position, the second supporting section 62 pivotally moves downward about the pivotal shaft 13 and, with this movement of the second supporting section 62, the third supporting section 63 rotatably moves counterclockwise in FIG. 5A about the axis of the pivotal shaft 13. When the upper casing 12 takes the closed position, the curvature radius of the tubes 43*a* decreases. However, because the inner side of curved portions of the tubes 43*a* is supported by the guiding surface 67*a* of the third supporting section 63, sharp bending of the tubes 43*a* can be suppressed. In this way, the third supporting section 63 is configured to rotatably move about the shafts 65*a* when the second supporting section 62 moves with pivotal movement of the upper casing 12. This configuration suppresses excessive stretch or excessive deflection of the tubes 43*a* between the first supporting section 61 and the second supporting section 62, when the second supporting section 62 moves with pivotal movement of the upper casing 12. That is, the moving range of the third supporting section 63 is restricted by the shafts 65*a* and the holes 69*a* of the frame 69. Hence, when the tubes 43*a* are deformed with pivotal movement of the upper casing 12, the third supporting section 63 rotatably moves due to deformation of the tubes 43*a*, thereby suppressing a load due to deformation of the tubes 43*a* that is applied to the tubes 43*a*. Assuming that the third supporting section 63 is configured not to rotatably move, the third supporting section 63 does not rotatably move even if the second supporting section 62 moves due to pivotal movement of the upper casing 12. In this case, there is a possibility that the tubes 43*a* between the second supporting section 62 and the third supporting section 63 are stretched excessively and that the tubes 43*a* bend sharply. On the other hand, assume that the third supporting section 63 is configured to move freely. In this case, there is a possibility that, when some external force is added to the third supporting section 63, the third supporting section 63 is displaced from a predetermined position, and the tubes 43*a* bend sharply.

As described above, according to the printer 1 of the present embodiment, the two tubes 43*a* are juxtaposed in a direction parallel to the axis of the pivotal shaft 13 even when the upper casing 12 is pivotally moved. Thus, when the upper casing 12 is pivotally moved, the two tubes 43*a* do not tend to twist together, thereby suppressing a part of the tubes 43*a* being bent sharply or stretched excessively.

Also, the third supporting section 63 has the guiding surface 67*a* that is curved so as to support the inner side of curved portions of the two tubes 43*a* supported by the two gripping sections 68. This configuration further suppresses a part of the tubes 43*a* being bent sharply and blocked.

Further, the guiding surface 67*a* is curved with a curvature radius that is larger than or equal to the smallest curvature radius of the tubes 43*a*. This configuration can reliably prevent a part of tubes from being bent sharply and blocked. That is, because the curvature radius of the tubes 43*a* supported by the guiding surface 67*a* is larger than or equal to the smallest curvature radius of the tubes 43*a*, sharp bending of the tubes 43*a* can be prevented reliably.

The moving range of the third supporting section 63 is restricted by the frame 69. Hence, even if an external force is applied to the third supporting section 63, the third supporting section 63 does not move to outside of the moving range. This configuration more reliably suppresses a part of the tubes 43*a* being bent sharply and blocked.

Further, the holes 69*a* of the frame 69 allow the third supporting section 63 to rotatably move about the same axis as the pivotal shaft 13. This can reduce the amount of displacement of the tubes 43*a* when the upper casing 12 pivotally moves. This configuration more reliably suppresses a part of the tubes 43*a* being bent sharply and blocked.

Second Embodiment

A printer 101 according to a second embodiment will be described while referring to FIGS. 8A through 9C wherein like parts and components are designated by the same reference numerals to avoid duplicating description.

Like the first embodiment, in each first range R1, the two tubes 43*a* connecting the two arranged ink-cartridge mount sections 41*a* and the two subsidiary tanks 42 are juxtaposed (arranged side by side) in the extending direction of the pivotal shaft 13. The two tubes 43*a* are supported by one first supporting section 161 fixed to the lower casing 11, and are also supported by one second supporting section 162 fixed to the upper casing 12.

Figure 8A:
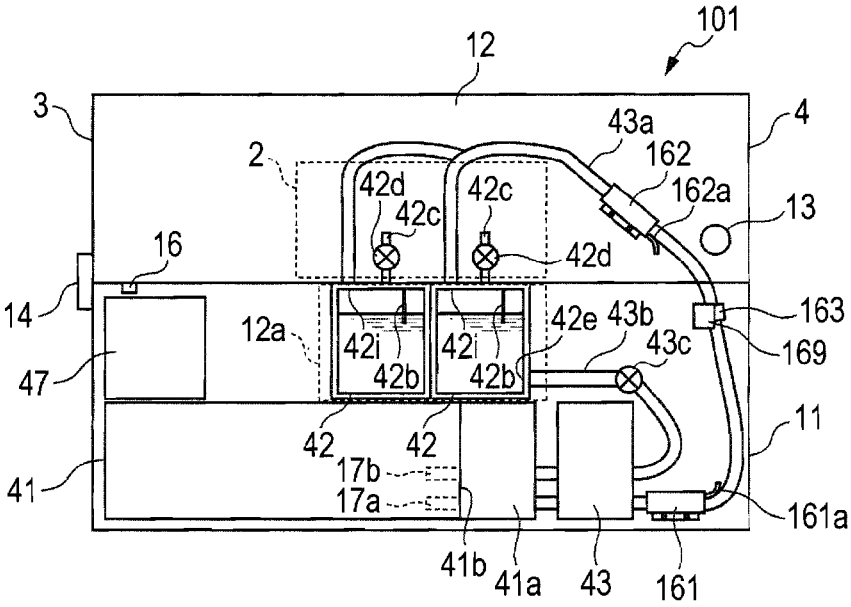
FIG. 8A is a schematic side view showing the internal structure of a printer according to a second embodiment of the invention, in a state where an upper casing is located at a closed position.
Figure 8B:
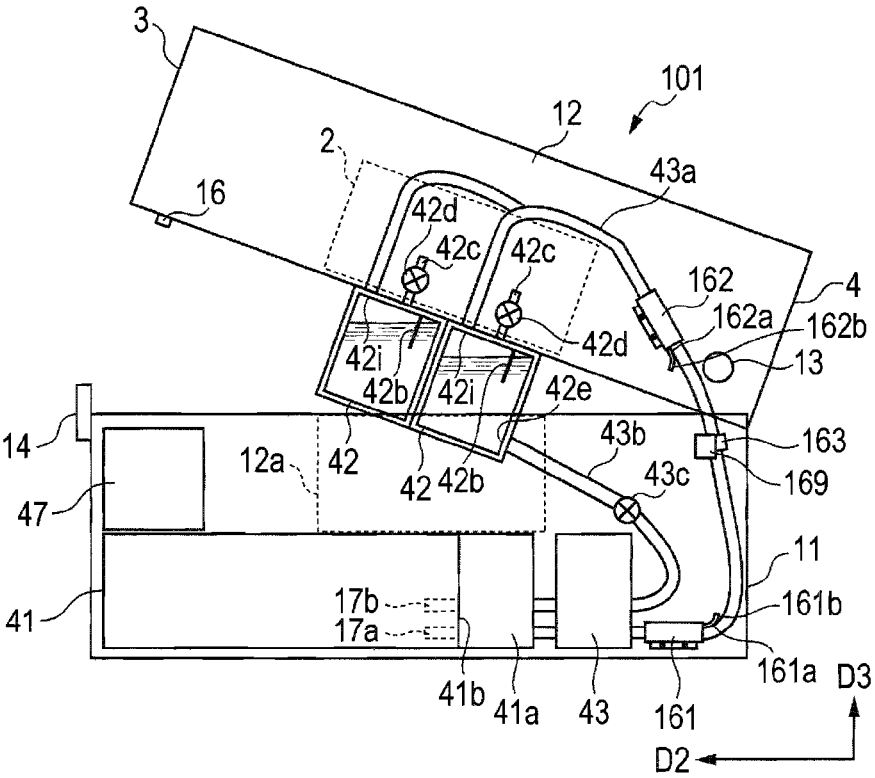
FIG. 8B is a schematic side view showing the internal structure of the printer according to the second embodiment, in a state where the upper casing is located at an open position.

As shown in FIGS. 8A and 8B, the first supporting section 161 is disposed at a lower side of the pivotal shaft 13. The first supporting section 161 includes a guide 161*a* having a guiding surface 161*b* that is curved so as to support the inner side of curved portions of the two tubes 43*a*. The second supporting section 162 is disposed at an upper side of the pivotal shaft 13. The second supporting section 162 includes a guide 162*a* having a guiding surface 162*b* that is curved so as to support the inner side of curved portions of the two tubes 43*a*. Further, the two tubes 43*a* are supported by one third supporting section 163 at a position between the first supporting section 161 and the second supporting section 162. The third supporting section 163 is supported by a frame 169 (a part of the restricting section) fixed to the lower casing 11.

Figure 9A:
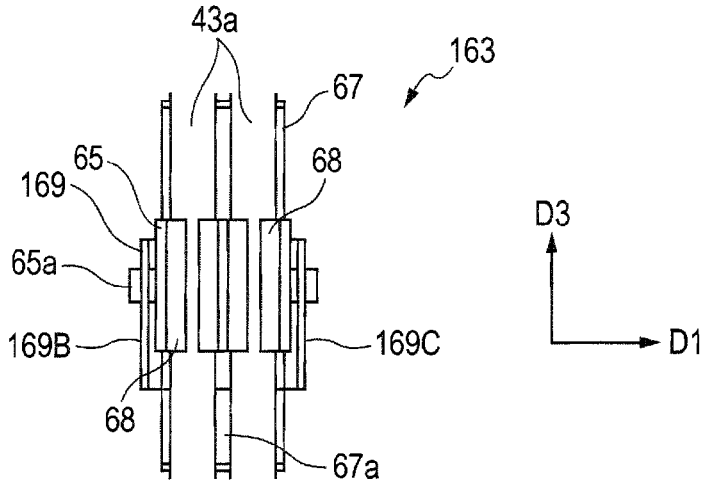
FIG. 9A is a rear view showing a third supporting section of the printer shown in FIGS. 8A and 8B.
Figure 9B:
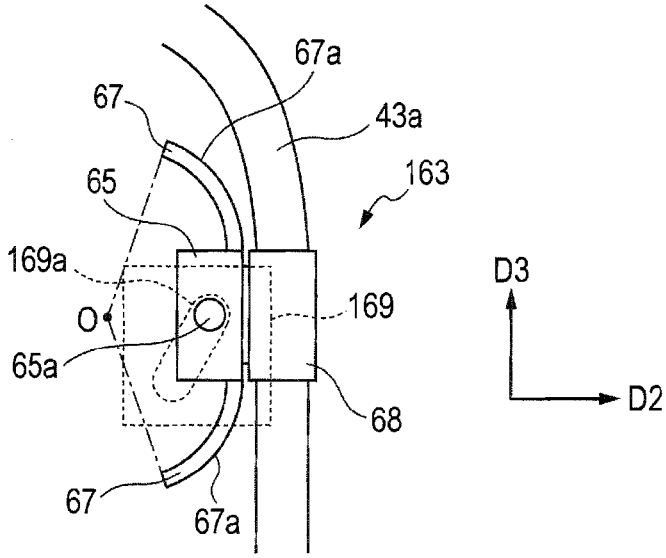
FIG. 9B is a side view of the third supporting section in a state where the upper casing shown in FIGS. 8A and 8B is located at the open position.
Figure 9C:
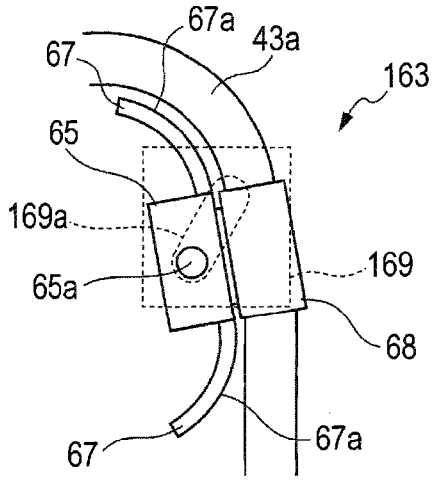
FIG. 9C is a side view of the third supporting section in a state where the upper casing shown in FIGS. 8A and 8B is located at the closed position.

As shown in FIGS. 9A through 9C, the frame 169 has a squared-U shape formed by plate members. Guiding holes 169*a* are formed in plate members 169B and 169C confronting each other. Each guiding hole 169*a* is an elongated hole extending in a direction from the right-upper side toward the left-lower side in FIG. 9B (a direction from the rear-upper side toward the front-lower side of the printer 101). That is, in the present embodiment, each guiding hole 169*a* extend linearly. However, this shape of the elongated hole is merely an example. For example, the elongated hole may be curved. Preferably, the shape of the elongated hole matches the direction of a trajectory along which the third supporting section 163 moves when the upper casing 12 moves between the closed position and the open position. The pair of shafts 65*a* of the block 65 is inserted in the pair of the guiding holes 169*a* of the frame 169. With this configuration, the moving range of the third supporting section 163 is restricted to the moving range of the shafts 65*a* in the guiding holes 169*a*. When the upper casing 12 is at the open position, as shown in FIG. 9B, the shafts 65*a* are located at the upper end of the guiding holes 169*a*. When the upper casing 12 is at the closed position, as shown in FIG. 9C, the shafts 65*a* are located at the lower end of the guiding holes 169*a*.

At the time of the maintenance operation, with pivotal movement of the upper casing 12 between the closed position and the open position, the second supporting section 162 moves relative to the first supporting section 161. When the upper casing 12 pivotally moves from the closed position to the open position, the second supporting section 162 moves away from the first supporting section 161. That is, the distance between the first supporting section 161 and the second supporting section 162 increases. Thus, with movement of the second supporting section 162, the tubes 43*a* supported by the first supporting section 161 and the second supporting section 162 are deformed to be stretched. That is, when the upper casing 12 pivotally moves from the closed position to the open position, the tubes 43*a* are deformed such that deflection of the tubes 43*a* decreases. At this time, with deformation of the tubes 43*a*, the third supporting section 163 supporting the tubes 43*a* between the second supporting section 162 and the first supporting section 161 moves such that the shafts 65*a* move along the guiding holes 169*a*. The third supporting section 163 moves within a range of the guiding holes 169*a* such that the two tubes 43*a* are curved smoothly between the first supporting section 161 and the third supporting section 163, and between the second supporting section 162 and the third supporting section 163, while maintaining a state in which the two tubes 43*a* are juxtaposed in a horizontal direction, that is, a direction parallel to the axis of the pivotal shaft 13. That is, the third supporting section 163 is configured to slidably move along the guiding holes 169*a* and also to rotatably move about the shafts 65*a*. Specifically, when the upper casing 12 pivotally moves from the closed position to the open position, the second supporting section 162 pivotally moves upward about the pivotal shaft 13 and, with this movement of the second supporting section 162, the third supporting section 163 moves such that the shafts 65*a* move upward in the guiding holes 169*a*. Conversely, when the upper casing 12 pivotally moves from the open position to the closed position, the second supporting section 162 pivotally moves downward about the pivotal shaft 13 and, with this movement of the second supporting section 162, the third supporting section 163 moves such that the shafts 65*a* move downward in the guiding holes 169*a*. When the upper casing 12 takes the closed position, the curvature radius of the tubes 43*a* decreases. However, the inner side of curved portions of the tubes 43*a* is supported by each of the guiding surface 161*b* of the first supporting section 161, the guiding surface 162*b* of the second supporting section 162, and the guiding surface 67*a* of the third supporting section 163. Thus, sharp bending of the tubes 43*a* can be suppressed. In this way, the third supporting section 163 is configured to move along the guiding holes 169*a* when the second supporting section 162 moves with pivotal movement of the upper casing 12. This configuration suppresses excessive stretch or excessive deflection of the tubes 43*a* between the first supporting section 161 and the second supporting section 162, when the second supporting section 162 moves with pivotal movement of the upper casing 12. That is, the moving range of the third supporting section 163 is restricted by the guiding holes 169*a*. Hence, when the tubes 43*a* are deformed with pivotal movement of the upper casing 12, the third supporting section 163 moves due to deformation of the tubes 43*a*, thereby suppressing a load due to deformation of the tubes 43*a* that is applied to the tubes 43*a*. Assuming that the third supporting section 163 is configured not to move slidably or rotatably, the third supporting section 163 does not move even if the second supporting section 162 moves due to pivotal movement of the upper casing 12. In this case, there is a possibility that the tubes 43*a* between the second supporting section 162 and the third supporting section 163 are stretched excessively and that the tubes 43*a* bend sharply. On the other hand, assume that the third supporting section 163 is configured to move freely. In this case, there is a possibility that, when some external force is added to the third supporting section 163, the third supporting section 163 is displaced from a predetermined position, and the tubes 43*a* bend sharply.

As described above, according to the printer of the present embodiment, the two tubes 43*a* are juxtaposed in a direction parallel to the axis of the pivotal shaft 13 even when the upper casing 12 is pivotally moved. Thus, when the upper casing 12 is pivotally moved, the two tubes 43*a* do not tend to twist together, thereby suppressing a part of the tubes 43*a* being bent sharply or stretched excessively.

Also, the frame 169 is fixed to the lower casing 11 that does not pivotally move. Hence, the moving range in the guiding holes 169*a* can be set (designed) easily.

Further, the moving range of the third supporting section 163 is defined by the guiding holes 169*a* that extend in one direction. This simple configuration can suppress a case in which the tubes 43*a* make contact with other members.

In addition, the first supporting section 161 includes the guide 161*a* having the guiding surface 161*b* that is curved so as to support the inner side of curved portions of the two tubes 43*a*. The second supporting section 162 includes the guide 162*a* having the guiding surface 162*b* that is curved so as to support the inner side of curved portions of the two tubes 43*a*. This configuration more reliably suppresses a part of the tubes 43*a* being bent sharply and blocked.

Modifications

While the invention has been described in detail with reference to the above aspects thereof, it would be apparent to those skilled in the art that various changes and modifications may be made therein without departing from the scope of the claims.

Figure 10A:
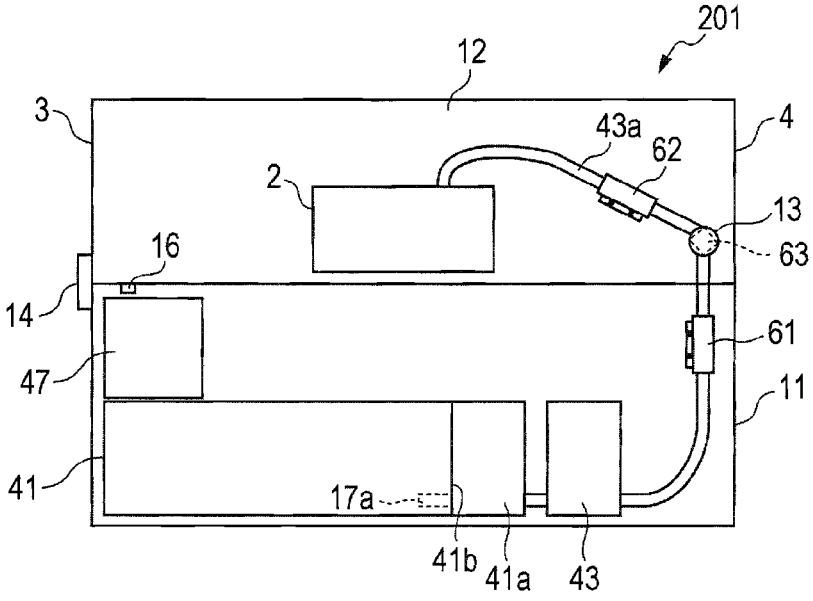
FIG. 10A is a schematic side view showing the internal structure of a printer according to a modification.

For example, in the above-described embodiment, the first through third supporting sections 61-63 support the tubes 43*a* connecting the subsidiary tanks 42 and the ink-cartridge mount sections 41*a*. However, members (liquid holders) connected by tubes may be arbitrary ones as long as the tubes are a plurality of tubes that transfer liquid between the lower casing 11 and upper casing 12. For example, as shown in FIG. 10A, the first through third supporting sections 61-63 may support the two tubes 43*a* that directly connect the inkjet head 2 fixed to the upper casing 12 and the ink-cartridge mount sections 41*a* fixed to the lower casing 11. In this modification, the two (2) tubes 43*a* connect the two (2) ink-cartridge mount sections 41*a* and the one (1) inkjet head 2. Here, a plurality of ink supply ports 21 is formed on the inkjet head 2. Thus, in this modification, the liquid holders (the inkjet head 2 and the plurality of ink cartridges 41) connected by the plurality of tubes 43*a* are not in a one-to-one correspondence. Such a configuration is also within the scope of the invention.

Figure 10B:
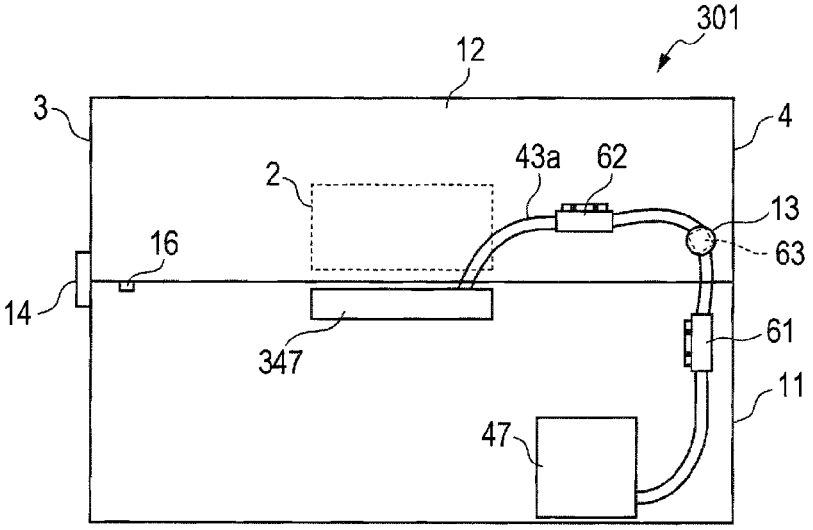
FIG. 10B is a schematic side view showing the internal structure of a printer according to another modification.

Or, as shown in FIG. 10B, the first through third supporting sections 61-63 may support the two tubes 43*a* that connect a receiving member 347 fixed to the upper casing 12 and the waste liquid tank 47 fixed to the lower casing 11. The receiving member 347 receives ink ejected from the inkjet head 2 during a maintenance operation and the like. Note that, in the modifications shown in FIGS. 10A and 10B, the third supporting section 63 has a support shaft (protruding sections) that rotatably moves about the same center axis as the pivotal shaft 13, like the first embodiment. In these modifications, however, the third supporting section may be the same type as the third supporting section 163 that is fixed to the lower casing 11, like the second embodiment.

Also, in the above-described embodiment, the third supporting section 63 includes the guides 67 that are curved so as to support the inner side of curved portions of the tubes 43*a*. However, one of the upper and lower guides 67 may be omitted, or the both of the upper and lower guides 67 may be omitted.

Further, in the above-described embodiment, the guiding surface 67*a* is curved with a curvature radius that is larger than or equal to a smallest curvature radius of the tubes 43*a*. However, the guiding surface 67*a* may be curved with a curvature radius that is smaller than the smallest curvature radius of the tubes 43*a*.

Further, in the above-described embodiment, the moving range of the third supporting section 63 is restricted by the frame 69. However, the printer may be so configured that the third supporting section is not fixed to the lower casing 11 nor the upper casing 12. Or, the third supporting section may be fixed to the upper casing 12.

Also, in the above-described embodiment, the holes 69*a* of the frame 69 allow the third supporting section 63 to rotatably move about the same axis as the pivotal shaft 13. However, the third supporting section 63 may be configured to rotatably move about a different axis from the axis of the pivotal shaft 13. In this configuration, it is preferable that the different axis be parallel to the axis of the pivotal shaft 13. However, the different axis may be slanted (not parallel) relative to the axis of the pivotal shaft 13.

In addition, in the above-described embodiment, the third supporting section 63 supports the two (2) tubes 43*a*. However, depending on the configuration of a printer, the third supporting section may support three (3) or more tubes. The liquid holders are not limited to the head, the tanks (ink cartridge, subsidiary tank, and waste liquid tank), and the liquid receiving member illustrated in the embodiments, and may be other members.

The invention is not limited to a printer, but is applicable to a facsimile apparatus, a copier, and the like. Liquid ejected from the head is not limited to ink, but may be any liquid. The recording medium is not limited to paper P, but may be any medium on which recording can be performed.

What is claimed is:

1. A liquid ejecting apparatus comprising:

a first casing;

a second casing configured to pivotally move about a pivotal axis relative to the first casing, the second casing being configured to take an adjacent position at which the second casing is adjacent to the first casing and a spaced position at which the second casing is farther spaced away from the first casing than at the adjacent position;

a plurality of liquid holders, a first part of the plurality of liquid holders including at least one liquid holder provided at the first casing, a second part of the plurality of liquid holders including at least one liquid holder provided at the second casing, the second part of the plurality of liquid holders being different from the first part of the plurality of liquid holders;

a plurality of flexible tubes each having one end and another end, the one end being connected to the first part of the plurality of liquid holders, the other end being connected to the second part of the plurality of liquid holders;

a first supporting section provided at the first casing and configured to support the plurality of tubes;

a second supporting section provided at the second casing and configured to support the plurality of tubes; and a third supporting section configured to support the plurality of tubes at a position between the first supporting section and the second supporting section in such a manner that the plurality of tubes is arranged in a direction parallel to the pivotal axis.

2. The liquid ejecting apparatus according to claim 1, wherein the third supporting section is configured to move relative to the first casing and the second casing.

3. The liquid ejecting apparatus according to claim 1, wherein the third supporting section comprises a first guide having a first guiding surface that is curved so as to support an inner side of curved portions of the plurality of tubes.

4. The liquid ejecting apparatus according to claim 3, wherein the first guiding surface is curved with a curvature radius that is larger than or equal to a smallest curvature radius of each of the plurality of tubes.

5. The liquid ejecting apparatus according to claim 1, further comprising:

a pivotal shaft extending in a direction of the pivotal axis and configured to couple the first casing with the second casing in such a manner that the second casing is pivotally movable relative to the first casing; and a restricting section fixed to one of the pivotal shaft, the first casing, and the second casing and configured to restrict a moving range of the third supporting section.

6. The liquid ejecting apparatus according to claim 5, wherein the restricting section is fixed to the first casing.

7. The liquid ejecting apparatus according to claim 5, wherein the restricting section is formed with a hole; and wherein the third supporting section has a protruding section extending in the direction parallel to the pivotal axis and configured to be inserted in the hole so that the third supporting section is rotatable about the protruding section.

8. The liquid ejecting apparatus according to claim 7, wherein the hole is a circular hole so that the third supporting section is rotatable about the protruding section without shifting a position of the third supporting section.

9. The liquid ejecting apparatus according to claim 7, wherein the hole is a guiding hole extending in a predetermined direction and defining the moving range, so that the protruding section is movable along the guiding hole.

10. The liquid ejecting apparatus according to claim 7, wherein the protruding section is located so that an axis of the protruding section is on the same straight line as the pivotal axis.

11. The liquid ejecting apparatus according to claim 5, wherein the restricting section is formed with a pair of holes; and wherein the third supporting section further comprises:

a rotatable member;

a pair of protruding sections protruding from both ends of the rotatable member in the direction parallel to the pivotal axis, the pair of protruding sections being inserted in the pair of holes so that the rotatable member is rotatable about the pair of protruding sections;

a plurality of gripping sections fixed to the rotatable member so as to grip respective ones of the plurality of tubes in such a manner that the plurality of tubes is arranged in the direction parallel to the pivotal axis; and a pair of first guides fixed to the rotatable member and each having a first guiding surface that is curved so as to support an inner side of curved portions of the plurality of tubes.

12. The liquid ejecting apparatus according to claim 1, wherein the first supporting section comprises a second guide having a second guiding surface that is curved so as to support an inner side of curved portions of the plurality of tubes.

13. The liquid ejecting apparatus according to claim 1, wherein the second supporting section comprises a third guide having a third guiding surface that is curved so as to support an inner side of curved portions of the plurality of tubes.

14. The liquid ejecting apparatus according to claim 1, wherein the second part of the plurality of liquid holders comprises a liquid ejecting head configured to eject liquid; and wherein the first part of the plurality of liquid holders comprises a tank configured to store liquid that is supplied to the liquid ejecting head.

15. The liquid ejecting apparatus according to claim 1, wherein the second part of the plurality of liquid holders comprises a first tank configured to store liquid; and wherein the first part of the plurality of liquid holders comprises a second tank configured to store liquid that is supplied to the first tank.

16. The liquid ejecting apparatus according to claim 1, further comprising a liquid ejecting head configured to eject liquid, wherein the second part of the plurality of liquid holders comprises a liquid receiving member configured to receive liquid ejected from the liquid ejecting head; and wherein the first part of the plurality of liquid holders comprises a waste liquid tank configured to store liquid received by the liquid receiving member.

* * * * *